US008061662B1

(12) United States Patent
Bartek

(10) Patent No.: US 8,061,662 B1
(45) Date of Patent: Nov. 22, 2011

(54) PORTABLE AUTOMATIC TRAIN TRIP COCK TRIPPER

(76) Inventor: Peter M. Bartek, Ledgewood, NJ (US)

( * ) Notice: Subject to any disclaimer, the term of this patent is extended or adjusted under 35 U.S.C. 154(b) by 0 days.

(21) Appl. No.: 12/658,272

(22) Filed: Feb. 9, 2010

(51) Int. Cl.
*B61L 1/00* (2006.01)

(52) U.S. Cl. ..... 246/203 R; 246/203 D; 246/203 E; 246/204; 246/207

(58) Field of Classification Search ..... 246/202, 246/201, 203 R, 203 A, 203 B, 203 C, 203 D, 246/203 E, 204, 205, 206, 207, 477, 488, 246/485, 103, 178, 200 R, 200 A, 200 B, 246/192 A; 188/111
See application file for complete search history.

(56) References Cited

U.S. PATENT DOCUMENTS 815,039 A * 3/1906 Romain ..... 246/103
942,099 A * 12/1909 Oyler ..... 246/200 A
1,109,693 A * 9/1914 Morrie ..... 188/63
1,174,023 A * 2/1916 Nevens ..... 246/202
1,174,024 A * 2/1916 Nevens ..... 246/202
1,186,237 A * 6/1916 Sedgwick ..... 246/203 B
1,323,991 A * 12/1919 Moore ..... 246/201
1,363,595 A * 12/1920 Higgins et al. ..... 246/202
1,377,955 A * 5/1921 Adams et al. ..... 246/185
1,664,834 A * 4/1928 Smith ..... 246/203 R
1,668,153 A * 5/1928 Heinrich ..... 246/207
1,701,040 A * 2/1929 Jennings ..... 188/63
2,660,959 A * 12/1953 Stickler, Jr. ..... 104/252
3,295,704 A * 1/1967 Gillick et al. ..... 414/388
5,601,259 A * 2/1997 DiChiara ..... 246/203 C
7,413,060 B2 * 8/2008 Takashi et al. ..... 187/414

* cited by examiner

*Primary Examiner* — Mark Le
(74) *Attorney, Agent, or Firm* — William Nitkin

(57) ABSTRACT

A portable trip cock tripper for use with a train having a trip cock mounted thereon, such trip cock tripper being manually positionable in desired locations adjacent to a track rail and remotely operated for movement of its tripper arm from a trip cock engaging position to a non-trip cock contacting position.

4 Claims, 3 Drawing Sheets

PORTABLE AUTOMATIC TRAIN TRIP COCK TRIPPER

BACKGROUND OF THE INVENTION

1. Field of the Invention

The device of this invention resides in the field of railway signaling systems for railroad personnel and others working in the vicinity of railroad tracks and more particularly relates to a portable trip cock tripper that can be remotely controlled and automatically moved from a trip cock contacting and activating position to a position that will not contact the train's trip cock depending upon the detection of movement of a train.

2. Description of the Prior Art

A train trip cock is well known in the prior art and is usually mounted on a rapid transit train. Such trip cock is interconnected to the train brake so that when the trip cock is actuated by a trip arm of a tripper affixed to the train track, the train brake is activated. Trip arms are usually attached to the tracks in an area that is prohibited to the train on which the trip cock is mounted. Trip cocks, once activated, will usually reset themselves. Frequently trippers are permanently installed on the track in areas where it is desired that trains not pass into, such as fixed train stops before dead end tracks. Portable trippers which are typically in the shape of a "T" are approximately 6-8 inches tall and extend above the running rail and can be manually installed on tracks in work zones to prevent trains from passing into areas where there are workers. When workers, such as a flag man, install a fixed tripper on a track, there is a problem should the train stop before hitting the tripper. Such situation would require the flag man or worker to enter the fouling area of the train and then manually remove the "T" part of the tripper to let the train pass by the tripper. After the train has passed, the flag man must enter the same area and replace the "T" arm back on the tripper, making such work area where trains pass very dangerous for the worker.

Usually at the exiting end of a work zone, there is no flag man. Thus, if a train is coming in a reverse direction, it will not be stopped by a tripper, again making such train traveling within the work zone very dangerous for a work crew. If a portable tripper were installed at the exiting end of a work zone, the tripper would come in contact with the trip cock, thus stopping and delaying the train from proceeding.

SUMMARY OF THE INVENTION

It is an object of this invention to provide an automatic portable trip cock tripper that can be installed adjacent to the rail of a track in a work zone that when in its "up" position will activate the trip cock on a train should it pass into the work zone. The automatic portable trip cock tripper can be moved remotely by a worker to a "down" position to allow a train to pass thereby. The portable automatic tripper of this invention eliminates the need for a flag man or worker to enter and exit the fouling location of the track multiple times to manually install or remove the tripper.

The automatic tripper of this invention can be utilized in one embodiment with a train detector that detects the presence and direction of movement of the train and can send a signal to the portable automatic tripper for its arm to be in a desired "up" or "down" position. If the portable automatic tripper is installed and in its "up" position at the beginning of a work zone, the flag man can carry in another embodiment a hand held device that, when activated by the flag man, can transmit a signal to the portable automatic tripper of this invention to cause it to move into its "down" position to allow a train to pass and such worker can use such hand held device to reactivate the portable automatic tripper to move the tripper arm upwards to its activation position once the train has passed. If a train is moving in a reverse direction and is detected by a train detector, the train detector or worker with a hand held device can send a signal to automatically activate the portable automatic tripper arm to move it into its "up" position to engage the train's trip cock and bring the train to a complete stop.

The portable automatic tripper of this invention includes a T-shaped arm that can pivot from an "up" position to a "down" position as such arm is mounted on a rotatable shaft, such shaft being interconnected to, and rotated by, an actuation motor. The electric motor is battery-operated and can include in one embodiment a special capacitor to provide extra power for fast movement thereof when needed, such as during an emergency actuation. The tripper arm is mounted on a plate that is attached to a rail of the track, as described below, and includes a control module with a receiver to receive RF signals to direct the tripper arm to move to its "up" position or rotate to its "down" position out of the way of the train's trip cock.

DESCRIPTION OF THE PREFERRED EMBODIMENT(S)

Figure 1:
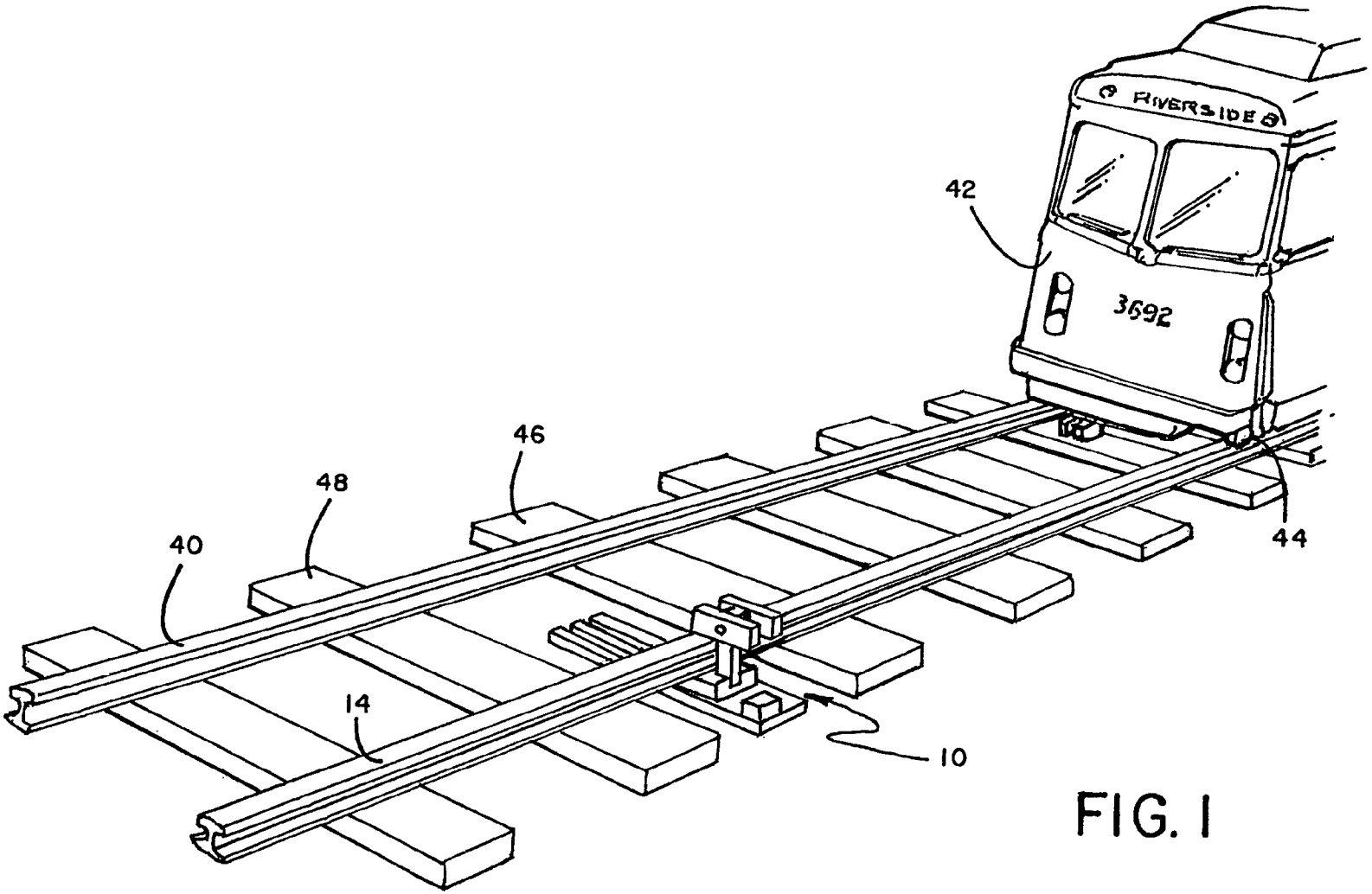
FIG. 1 illustrates a perspective view of the portable automatic trip cock tripper of this invention mounted on a rail of a track showing a train approaching.
Figure 2:
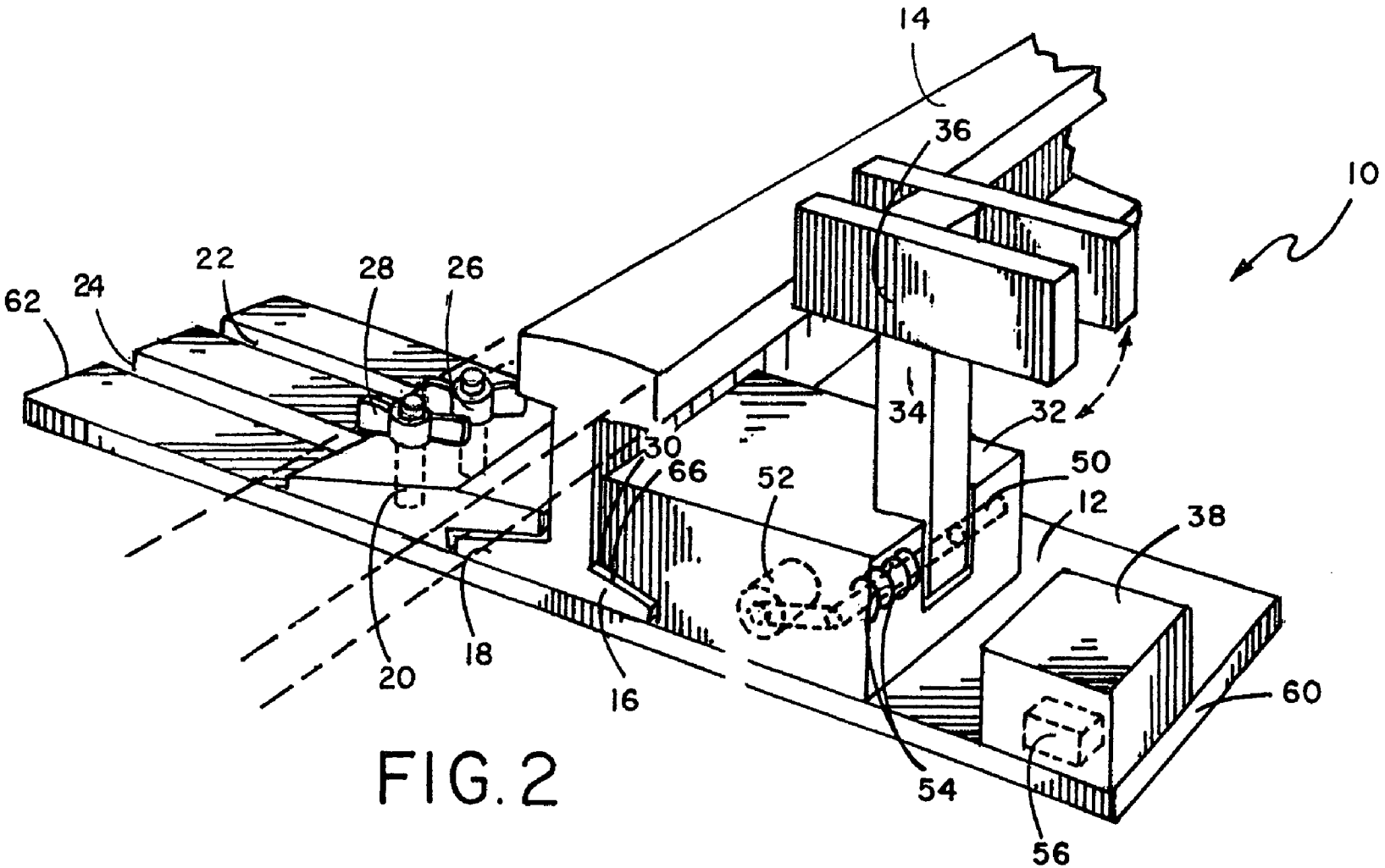
FIG. 2 illustrates an enlarged perspective view of the portable automatic trip cock tripper of this invention showing the tripper in the "up" position.
Figure 3:
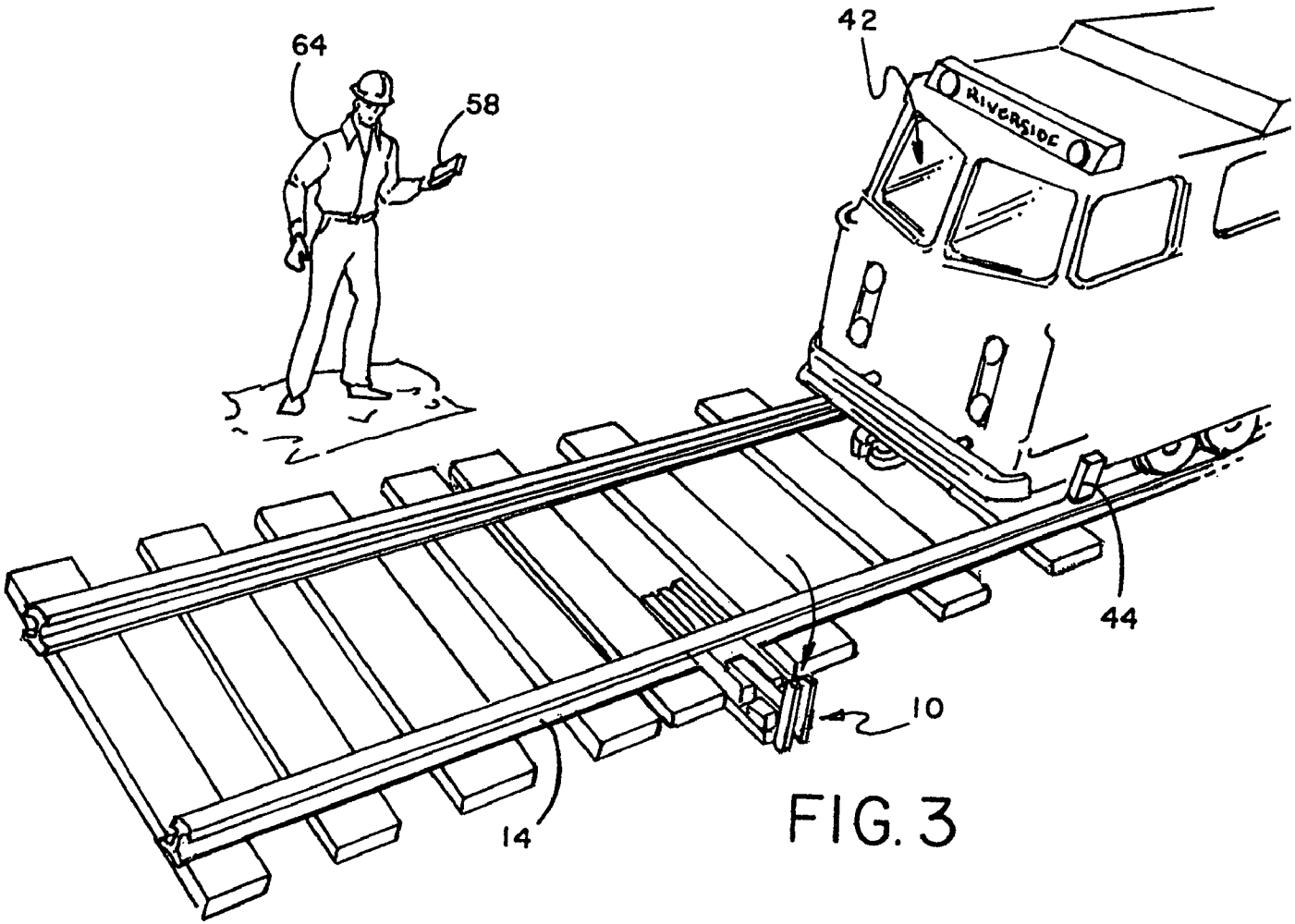
FIG. 3 illustrates a perspective view of the portable automatic trip cock tripper of this invention showing the tripper in the "down" position.

As seen in FIGS. 1 and 2, portable automatic trip cock tripper 10 is mounted at first end 60 of generally elongated planar mounting plate 12. At second end 62 of mounting plate 12 are defined first and second slots 22 and 24. The slots extend parallel to one another and are aligned extending from the second end 62 of mounting plate 12 toward first end 60. Portable automatic tripper 10 has movable arm 34 mounted on shaft 50 which rotates arm 34 from the "up" position, as seen in FIG. 2, to the "down" position, as seen in FIG. 3, and vice versa. Shaft 50 is rotatably mounted in housing 32 which contains electric motor 52, shown in dashed lines in FIG. 2, that rotates arm 34 to the "down" position when activated. Spring 54 can be mounted in association with shaft 50 which rotates arm 34 back to the "up" position when electric motor 52 is deactivated. Control module 38 is also mounted on mounting plate 12 at first end 60 which control module 38 contains an RF receiver 56 which receives signals from a hand held device 58 held by a worker 64, as seen in FIG. 3, or from a train detector. Hand held device 58 sends a signal to RF receiver 56 which controls and directs electric motor 52 as to whether arm 34 moves tripper 36 to the "down" position or whether electric motor 52 is deactivated for spring 54 to return arm 34 to its "up" position.

Mounting plate 12 is positioned under a rail, such as rail 14, so that portable automatic tripper 10 is located to the exterior of the track and is aligned when in the "up" position with trip cock 44 on train 42. Once the worker carries portable automatic tripper 10 to the area where it is to be installed, mounting plate 12 is passed under rail 14, such as between first rail tie 46 and second rail tie 48, as seen in FIG. 1. Within first and second slots 22 and 24 are positioned, respectively, first and second bolts 26 and 28 which pass through clamp 20. Clamp 20 is movable along the upper surface of mounting plate 12 with first and second bolts 26 and 28 moving, respectively, within first and second slots 22 and 24 to a position where clamp 20 has a portion thereof positioned over inner top surface 18 of rail base 16. In this position first and second bolts 26 and 28 are tightened, engaging clamp 20 tightly to mounting plate 12, and tightly and securely engaging rail base 16 therebetween. At the same time an extended portion 66 of motor housing 32 engages over and retains outer top surface 30 of rail base 16 so as to securely mount portable automatic tripper 10 to first rail 14 opposite second rail 40 of the track.

In use electric motor 52 lowers arm 34 when voltage is supplied thereto and electric motor 52 rotates against the force of spring 54. Motor 52 receives such control signals through control module 38 to lower arm 34.

Although the present invention has been described with reference to particular embodiments, it will be apparent to those skilled in the art that variations and modifications can be substituted therefor without departing from the principles and spirit of the invention.

I claim:

1. A portable and relocatable at will trip cock tripper device for use with a train having a trip cock connected to the train brake and which runs on a track having two discrete rails, an interior defined between the two rails, and a plurality of railroad ties supporting said track rails, wherein each rail has an interior side, an exterior side and a rail base, said tripper device comprising:

a rotatable on-demand tripper arm;

an elongated mounting plate for manual placement at will in a selected site location under one of the track rails and between two supporting railroad ties, said mounting plate having first and second ends, said first end of said mounting plate to be disposed on the exterior side of a single rail and said second end of said mounting plate to be disposed on the interior side of the same rail;

a housing affixed to said first end of said mounting plate suitable for disposition adjacent to the exterior side of a single rail of the track, said housing having first and second ends;

a rail base retention area defined in said second end of said housing suitable for attachment and retention of said tripper device to the single rail base at said selected site location;

rotation means defined in said first end of said housing for attachment to, and on-demand rotation of, said tripper arm from a preset trip cock engaging position to a predetermined non-striking position, and for on-demand rotation of said tripper arm from a predetermined non-striking position to a preset trip cock engaging position;

clamping means disposed on said second end of said mounting plate suitable for initial at will attachment and retention and subsequent at will detachment and removal of said tripper device to and from a single rail at a selected site location;

radio frequency signal receipt means disposed on said mounting plate for receipt of an individual directing radio frequency signal and for controlling the on-demand rotation of said tripper arm, wherein said individual directing radio frequency signal is one selected from the group consisting of a first signal for rotating said tripper arm to a preset trip cock engaging position and a second signal for rotating said tripper arm to a predetermined non-striking position; and a remote controller capable of sending a plurality of individual directing radio frequency signals, said remote controller being manually operable for on-demand sending of individual directing radio frequency signals to said radio frequency signal receipt means.

2. The tripper device of claim 1 wherein said clamping means are manually adjustable in position on said mounting plate and are manually tightenable over the rail base.

3. The tripper device of claim 2 further including:

a pair of slots defined in said second end of said mounting plate which extend, toward said first end of said mounting plate; and at least one pair of bolt members extending through said clamping means, each bolt member passing through one slot of said pair of slots, said slots allowing for lateral movement of said clamping means along said mounting plate and for tightening said clamping means.

4. The tripper device of claim 3 wherein said housing further includes:

a rotatable shaft attached to said tripper arm;

a spring mounted in association with said rotatable shaft;

a motor connected to and operative on-demand for rotating said shaft; and a source of energy for powering said motor.

* * * * *